United States Patent [19]

Miller et al.

[11] Patent Number: 4,529,200

[45] Date of Patent: Jul. 16, 1985

[54] GAME BALL

[76] Inventors: Richard E. Miller, 6119 Cowan Mill Rd., Douglasville, Ga. 30135; James L. Muhlfelder, 563 Kenwood Ave., Delmar, N.Y. 12054

[21] Appl. No.: 453,794

[22] Filed: Dec. 27, 1982

[51] Int. Cl.[3] ..... A63B 37/00

[52] U.S. Cl. ..... 273/60 B; 273/DIG. 22

[58] Field of Search ..... 273/225, 60 R, 60 A, 273/60 B, DIG. 5, DIG. 11, DIG. 22, 58 A, 199 R

[56] References Cited

U.S. PATENT DOCUMENTS

| | | | |
|---|---|---|---|
| 2,532,839 | 12/1950 | Fawick | 273/58 A |
| 3,652,088 | 3/1972 | Marsh | 273/DIG. 5 X |
| 3,940,145 | 2/1976 | Gentiluomo | 273/199 R |
| 3,976,295 | 8/1976 | Heald | 273/60 B |
| 4,144,297 | 3/1979 | Tomar | 273/60 B X |
| 4,149,720 | 4/1979 | Heald | 273/60 B |
| 4,211,407 | 7/1980 | Tomar | 273/60 B |
| 4,272,079 | 6/1981 | Nakade et al. | 273/225 |

FOREIGN PATENT DOCUMENTS

| | | | |
|---|---|---|---|
| 763821 | 7/1967 | Canada | 273/225 |
| 165592 | 7/1921 | United Kingdom | 273/58 A |

*Primary Examiner*—George J. Marlo

*Attorney, Agent, or Firm*—James B. Middleton

[57] ABSTRACT

A game ball and method for making the ball. The game ball is for use as a conventional, standard baseball or softball having the desired size, rebound and sound when hit. The ball includes a conventional preformed core of cork or the like, and a plastic shell covering the preformed core in lieu of the conventional windings. The conventional leather cover is received over the shell to complete the ball. The shell may be molded of 100% ionomer resin, or ethylene vinyl acetate may be added up to 25% to reduce the rebound, the ionomer resin and EVA being mixed together before molding the shell. The thickness of the shell is at least one-sixteenth inch to provide the desired rebound, and the shell is spherical with a diameter such that the covered ball will have the standard diameter. A liquid anti-bonding agent may cover the preformed core between the core and the shell, the anti-bonding agent being sodium oleate, silicone or urethane.

3 Claims, 7 Drawing Figures

GAME BALL

FIELD OF THE INVENTION

This invention relates generally to game balls, and is more particularly concerned with a baseball or softball having a preformed core in combination with a plastic shell, and a conventional cover over the plastic shell.

BACKGROUND OF THE INVENTION

In the manufacture of game balls such as baseballs, softballs and the like, it is well known to make a core, and cover the core with a material to provide the necessary strength and resilience, followed by an outer, leather cover. The preformed cores have typically been made of a wide variety of materials, two of the most popular cores being kapok and cork. It will be recognized, of course, that each of these materials has insufficient strength to act as a game ball; therefore, an intermediate material, such as windings of string or yarn, is normally placed over the preformed core to give the ball the required strength, resilience and sound when hit with a bat. The finished winding or other material receives a conventional cover thereover so the completed ball will be the predetermined size in accordance with the game to be played.

There has long been considerable difficulty with the prior art balls made with the preformed core, the winding and the leather cover. First, the strength of the ball is simply insufficient for the ball to withstand for very long the extremely large forces involved in a baseball game. It is not uncommon for a baseball to have a playable life shorter than one baseball game simply because the cover will split, the windings will break, and the core will become sufficiently non-spherical that the ball will not have the proper handling and flight characteristics. Additionally, it will be understood that string, kapok, cork and the like will absorb moisture so that, if the ball becomes wet, the weight of the ball will be tremendously increased and the strength of the ball will be decreased. Once the ball is wet, the ball will deform rather easily, so the ball is not acceptable in a conventional baseball or softball game.

With the vast technology in plastic materials, there have been several balls formed of foamed plastics. These have taken the form of a molded sphere of expanded plastic material, the sphere being covered by the conventional leather cover, with or without an intermediate winding of string. These balls also have not met with great success. In some balls, the coefficient of restitution of the ball is too great, which is to say the ball rebounds better than is desired. When hit by a baseball bat, such a ball travels so fast as to be a distinct danger to players. Also, when some plastic balls are cold, they become so dense as to bend a metal bat. A ball has been made of a cross-linked polyurethane, and this ball has been found to be affected by changes in climate so that the ball is not consistent. Also, the polyurethane ball tends to take a compression set, so the sphericity is not guaranteed during play. Furthermore, the game ball industry has an investment in manufacturing facilities for making the preformed core for a game ball, so it is desirable to retain the preformed core, yet to improve the ball to overcome the above mentioned difficulties and to make a ball that meets current demands for a game ball. While some of the previous plastic balls rebound too greatly, it is desired to have a ball with a somewhat greater coefficient of restitution than the conventional cork and string ball, and to have the desired sharp sound when the ball is hit with a bat.

SUMMARY OF THE INVENTION

The present invention overcomes the above mentioned and other difficulties with the prior art game balls by providing a game ball including a generally conventional preformed core provided with a thermoplastic shell covering the preformed core. The thermoplastic shell then receives the conventional cover thereover to complete the ball. The thermoplastic shell is placed over the core in such fashion that there are no voids or gas pockets within the shell, and the core presses snugly in all directions against the plastic shell. The plastic shell has such strength that the resulting ball has an indeterminate life.

In one form of the invention, the thermoplastic shell is pressed directly against the core, and the shell adheres or otherwise bonds to the core. With use of the ball, the outer surface of the core somewhat disintegrates so the shell is no longer against the core. The ball remains completely playable and durable, but may have a slightly increased coefficient of restitution.

In another form of the invention, the preformed core is coated with an anti-bonding agent before the plastic shell is added. In this embodiment of the invention, the core remains constant, and the coefficient of restitution remains constant for the life of the ball.

The method of the invention includes the steps of providing the conventional preformed core, and providing two hemispheres of a thermoplastic such as EVA or "surlyn" ionomer resin made by duPont. The hemispheres are thicker at the center than they are at the open edges. If the anti-bonding agent is used, the anti-bonding agent coats the preformed core, then the two hemispheres are placed over the core, and the assembly is placed into a heated mold. Through the application of heat and pressure, the thermoplastic material is caused to flow from the thicker areas of the hemispheres towards the thinner areas. At the proper time, sufficient pressure is applied to urge the two hemispheres together and cause the hemispheres to weld and create the completed ball, ready to receive the final, conventional cover.

BRIEF DESCRIPTION OF THE DRAWINGS

These and other features and advantages of the present invention will become apparent from consideration of the following specification, when taken in conjunction with the accompanying drawings, in which.

DESCRIPTION OF AN EMBODIMENT OF THE INVENTION

Figure 1:
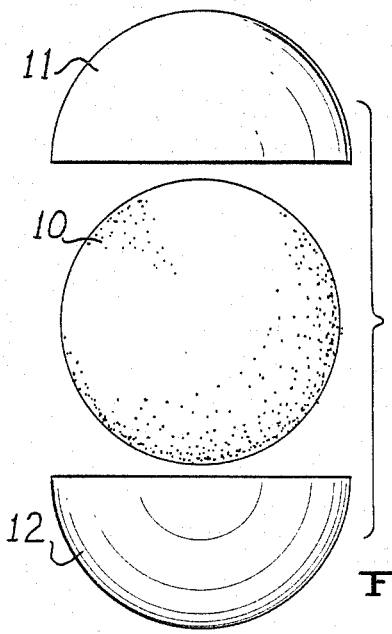
FIG. 1 is an exploded view showing a conventional preformed core with plastic hemispheres of the present invention adjacent thereto.

Referring now more particularly to the drawings, and to that embodiment of the invention here presented by way of illustration, FIG. 1 shows the preformed core 10 with two hemispheres 11 and 12. It will be understood that the preformed core 10 can be made of virtually any material since the purpose of the core 10 is only to provide a vehicle for the plastic shell, and the core 10 is not utilized for strength. It will be understood, however, that the final weight of the ball will be largely determined by the weight of the core 10. Nevertheless, it is well known to those skilled in the art that the preformed core 10 can be made of such weight and size that the finished ball will meet the desired standards.

Figure 2:
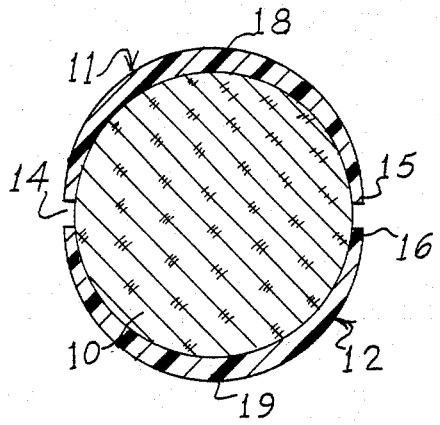
FIG. 2 is a cross-sectional view taken diametrically through the core of FIG. 1 with the hemispheres placed thereon.

Looking especially at FIG. 2 of the drawings, it will be seen that, when the hemispheres 11 and 12 are placed around the preformed core 10, there is a space 14 between the hemispheres. Also, it will be observed that the portion of the hemispheres at their axes is thicker. Thus, considering the edges 15 and 16 of the hemispheres 11 and 12 respectively as the equator, the pole portions 18 and 19 are made thicker than the equatorial portions.

While various balls may require different dimensions, and the thickness of the thermoplastic material can be varied somewhat depending on the final ball design, one successful ball has been made with hemispheres having the pole 18 and 19 around 3/16 of an inch thick, or about 4.7 mm., while the equatorial portions are about 3/32 of an inch, or about 2.4 mm. As a result it will be understood that the space 14 between the hemispheres as shown in FIG. 2 of the drawings will be approximately $\frac{1}{8}$ inch or about 3 mm.

Figure 3:
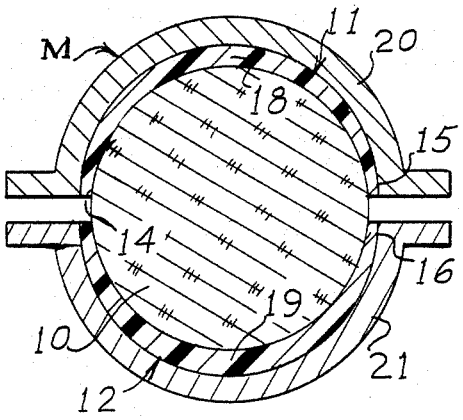
FIG. 3 is a view similar to FIG. 2 showing the hemispheres within a mold.

With the hemispheres 11 and 12 placed on the preformed core 10 as shown in FIG. 2 of the drawings, the assembly is then placed into a mold M as shown in FIG. 3 of the drawings.

At this point it should be understood that the hemispheres 11 and 12 are made of a thermoplastic, and one material that has been found to be very successful is the ionomer "Surlyn" made by duPont. The best ball is formed by using 100% "Surlyn"; however, it is possible to use some ethylene vinyl acetate (EVA). The addition of some EVA causes the ball to have a duller sound but the ball will otherwise still be acceptable. Depending on the final characteristics desired, the EVA can be as little as 5% to 10%, and may be 100% of the material. The increase in EVA causes the ball to have a more rubbery consistency so that the ball loses sound and has slightly less rebound, but the ball may be somewhat easier to weld together thermally because of the ease of welding EVA as opposed to "Surlyn". It will also be understood by those skilled in the art that various fillers and the like can be used in conjunction with the thermoplastic material. It is well known that glass, for example, may tend to give the balls some resilience; however, using "Surlyn", it has been found that the coefficient of restitution of the ball is highly desirable, and in fact needs no fillers or the like.

Referring again to FIG. 3 of the drawings, it will be understood that the assembly shown in FIG. 2 is placed within a heated mold M, here shown as comprising the mold pieces 20 and 21, and the mold pieces 20 and 21 will be forced together by a conventional press or the like (not shown). Using "Surlyn" as the thermoplastic material for the hemispheres 11 and 12, the mold M will be heated to 350° F. or 175° C. It is important to note in FIG. 3 of the drawings that the mold pieces 20 and 21 have a space therebetween, the space being approximately equal to the space 14 between the equatorial edges 15 and 16 of the hemispheres 11 and 12. This arrangement is such that the mold M can heat the hemispheres 11 and 12 until the material of the hemispheres 11 and 12 becomes deformable, or in a plastic state. The technique is, then, to heat the plastic hemispheres 11 and 12 with the heated mold M, and to squeeze the hemispheres 11 and 12 so that all air and other gases are forced from the mold. Because of this technique, when the hemispheres 11 and 12 are welded together, there will be no pockets of air or other gases.

In order to create a proper weld along the equatorial portions of the hemispheres 11 and 12, it is important to recognize that "Surlyn" must be welded at a particular point in its thermal cycle. When "Surlyn" is heated, the material will thermally expand, then will contract, and will expand again. If the mold pieces 20 and 21 are forced together during the initial expansion, or during the subsequent contraction, the hemispheres 11 and 12 will not weld adequately, and the seam will break on impact. Rather, one will place the assembly shown in FIG. 2 within the heated mold M as shown in FIG. 3, and the initial expansion of the "Surlyn" can be noted, followed by the contraction. After the contraction, one will note the second expansion; then, the mold pieces 20 and 21 will be forced together so the edges 15 and 16 of the hemispheres will merge. With this technique, there will be a true weld between the two hemispheres, and the weld will be strong enough to withstand the forces involved in a conventional baseball game or the like. It has been found that the weld will have approximately 90% of the strength of the material itself. Those skilled in the art will realize that the material has sufficient strength that 90% of that strength will make a baseball with a very long life, even in professional play.

Figure 4:
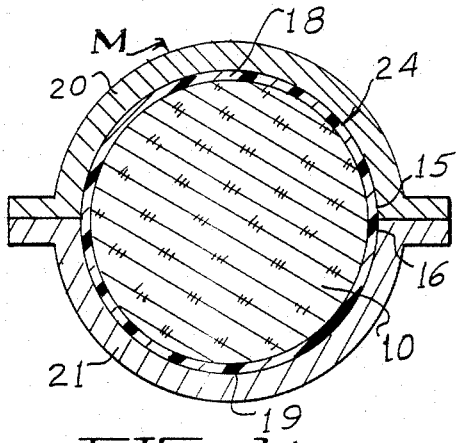
FIG. 4 is a view similar to FIG. 3 showing the mold after the mold pieces have been urged together.

Looking at FIG. 4 of the drawings, it will be seen that, when the mold pieces 20 and 21 are placed completely together to weld the hemispheres 11 and 12 to each other, the poles 18 and 19 of the hemispheres have been squeezed down until they are the same thickness as the equatorial portions 15 and 16 of the hemispheres. It will be obvious that there is excess plastic material in the hemispheres. This is needed for the above described process in assuring that the resulting shell 24 is snugly against the preformed core 10. Those skilled in the art will realize that, due to the presence of the excess plastic material, an overflow ring will be required in the molding machine. The overflow ring is not here illustrated, but it is well known to those skilled in the art and no further description is thought to be necessary.

The above described process produces an excellent game ball, with a very long life. Using the above described process, however, the thermoplastic shell tends to bond to the preformed core. As the ball is hit with a bat, the thermoplastic shell deforms and quickly recovers its spherical shape. This action creates shear forces on the core that cause gradual disintegration of the outer portions of the core. As a ball is used, the disintegration will progress to a distance of around $\frac{1}{4}$ inch to $\frac{3}{8}$ inch into the core.

Even after the surface disintegration of the core, the ball of the present invention is a completely playable ball, and still has an indeterminate life. When the core no longer presses against the thermoplastic shell, however, the coefficient of restitution of the ball is somewhat increased.

It has been found that the optimal finished wall thickness of the shell is about 1/16 inch, or 1½ mm. With this wall thickness, the coefficient of restitution will increase only about 10% over the life of the ball. As the wall thickness increases, the increase in rebound increases, so the ball can be designed to produce any desired rebound characteristics.

Figure 7:
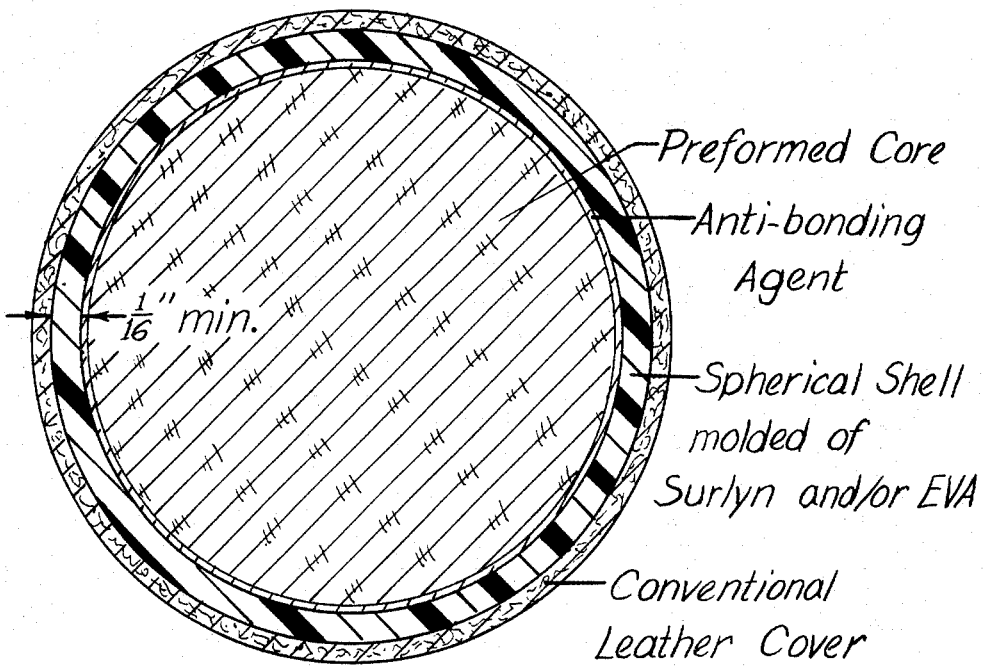

Further, if it is desired to have a ball that does not increase in rebound, the preformed core 10 is coated with an anti-bonding agent before the hemispheres 11 and 12 are placed over the core. This construction is shown in FIG. 7 of the drawings. When the core is not bonded to the shell, the core does not disintegrate so the rebound characteristics of the ball remain constant.

In selecting an anti-bonding agent, one must use a material that will coat the core without causing injury to the core. Then, the anti-bonding agent must have no affinity for the material of the thermoplastic shell. While the "Surlyn" ionomer resin is not attacked by most of the usual solvents, use of other thermoplastics will require caution in selecting the material.

One of the preferred anti-bonding agents is sodium oleate. This material is readily soluble in water or alcohol, and will coat the preformed core without any deleterious effect on the core. The shell can then be placed over the core as described, and an excellent ball will result.

Another anti-bonding agent that works quite well is urethane. Again, the urethane causes no problems with the core, and prevents bonding of the core to the shell, resulting in an excellent ball.

Silicone may also be used as an anti-bonding agent. A fluid silicone, undiluted, works admirably to prevent bonding of the core to the shell, so a successfully completed ball using silicone as an anti-bonding agent is of outstanding quality. In using silicone, however, it is important to prevent the silicone from coating the edges 15 and 16 of the hemispheres 11 and 12 because the presence of the silicone will prevent an adequate weld.

Figure 5:
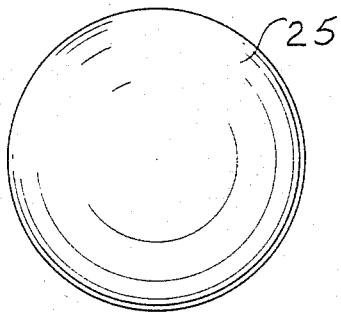
FIG. 5 is an elevational view of the ball of the present invention after it has been removed from the mold.
Figure 6:
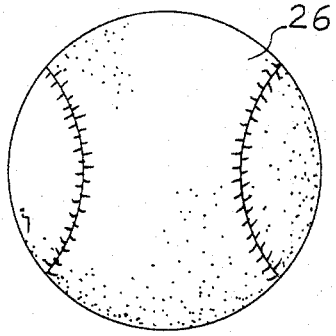
FIG. 6 is an elevational view of the ball of FIG. 5 after the cover has been added; and, FIG. 7 is an enlarged cross-sectional view taken through the ball of FIG. 6.

Looking now at FIG. 5, the resulting ball 25 is shown after being removed from the mold M, and FIGS. 6 and 7 show the ball of FIG. 5 after the conventional cover 26 has been added.

From the foregoing it should be understood that the present invention provides a game ball that allows the use of the conventional preformed core of cork, kapok, feathers or virtually any other material. The hemispheres 11 and 12 can be formed by injection molding so the hemispheres can be formed extremely accurately, to close tolerances. Placing the hemispheres over the preformed core, and placing the assembly within a two-piece mold as described provides a relatively simple procedure for completing the ball. The thermal cycle of expansion, contraction, and expansion of the "Surlyn" can be readily observed so that one will know when to force the mold pieces together to complete the weld; however, it is also possible to automate this system on the basis of time so that, once the particular ball has been designed, the mold pieces can be arranged to clamp after a predetermined time to weld the two hemispheres together.

It will further be understood that a ball having the shell of 100% "Surlyn" will provide an excellent ball with good sound, good resilience, and excellent durability; however, if the sound needs to be reduced somewhat, EVA can be added without losing the overall quality of the ball, and for a duller sound and less rebound the EVA can be increased up to 100%. If a softball is desired, of course the preformed core 10 would be the appropriate size, and the hemispheres 11 and 12 would be sized to result in a ball that meets standards for softball. On the other hand, if a baseball is desired, the preformed core 10 and hemispheres 11 and 12 would be so sized as to result in a ball that meets standards for baseball.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

We claim:

1. A game ball, for use in playing a baseball or softball game, said game ball including a spherical preformed core of a material selected from the group consisting of cork, kapok and feathers, an intermediate material covering said preformed core to provide strength, resilience and sound, and a leather cover over the intermediate material, said game ball being characterized in that said intermediate material comprises a spherical shell formed of a thermoplastic material consisting of at least 75% ionomer resin, said spherical shell being closely formed to said preformed core, said spherical shell completely covering said preformed core and having a wall thickness of at least one-sixteenth inch, said spherical shell providing strength and resilience for causing the ball to remain spherical and have constant resilience during play, said spherical shell further providing the sound when the ball is hit, said preformed core providing weight for said ball, said spherical shell having said leather cover thereover.

2. A game ball as claimed in claim 1, and further including a liquid anti-bonding agent covering said preformed core and disposed between said preformed core and said spherical shell for preventiing adhesion of said thermoplastic material of said spherical shell to said preformed core, said anti-bonding agent being selected from the group consisting of sodium oleate, urethane and silicone.

3. A game ball as claimed in claim 1, said thermoplastic material including from 5% to 25% ethylene vinyl acetate.

* * * * *